United States Patent [19]

Mulvany

[11] 4,200,518

[45] Apr. 29, 1980

[54] HEAT EXCHANGER ANTI-FOULANT

[75] Inventor: Paul K. Mulvany, New Orleans, La.

[73] Assignee: Chevron Research Company, San Francisco, Calif.

[21] Appl. No.: 22,672

[22] Filed: Mar. 22, 1979

[51] Int. Cl.[2] ..... C10G 9/16; C10G 7/00; C10L 1/10

[52] U.S. Cl. ..... 208/48 AA; 48/58; 208/348

[58] Field of Search ..... 208/48 AA, 348; 44/58

[56] References Cited

U.S. PATENT DOCUMENTS

| | | | |
|---|---|---|---|
| 3,224,957 | 12/1965 | Kent | 208/48 AA |
| 3,438,757 | 4/1969 | Honnen et al. | 44/58 |
| 3,554,897 | 1/1971 | Stanley | 208/48 AA |
| 3,565,804 | 2/1971 | Honnen et al. | 252/50 |
| 3,666,656 | 5/1972 | Stanley | 208/48 AA |
| 3,776,835 | 12/1973 | Dvoracek | 208/48 AA |
| 3,898,056 | 8/1975 | Honnen | 44/58 |
| 4,022,589 | 5/1977 | Alquist et al. | 44/58 |
| 4,055,402 | 10/1977 | Battersby et al. | 44/58 |
| 4,090,946 | 5/1978 | Nottes et al. | 208/48 AA |

*Primary Examiner*—Delbert E. Gantz
*Assistant Examiner*—G. E. Schmitkons
*Attorney, Agent, or Firm*—S. R. LaPaglia; J. J. DeYoung

[57] ABSTRACT

Disclosed is a process for reducing the fouling in a heat exchanger in which a hydrocarbon stream is heated or cooled as it passes through the heat exchanger. From 1 to 500 parts per million of a polyalkylene amine is added to the stream to reduce fouling.

9 Claims, No Drawings

HEAT EXCHANGER ANTI-FOULANT

BACKGROUND OF THE INVENTION

The invention relates to heat exchangers, particularly heat exchangers used in the processing of crude oil. More particularly, the invention relates to an additive for reducing heat exchanger fouling.

In the processing of petroleum, numerous heat exchangers are utilized to heat or cool process streams. Since refineries typically process very large quantities of petroleum ranging from 25,000 to 200,000 or more barrels per day, the heat exchangers in the refinery represent a very large capital investment. After a period of operation, deposits build up on the heat exchanger tubes greatly reducing heat exchanger efficiency. Eventually, the heat exchanger must be taken out of operation and the tubes cleaned or replaced.

DESCRIPTION OF THE PRIOR ART

Hydrocarbylamines are well known in the art for their deposit control properties in hydrocarbon fuels. See, for example, U.S. Pat. No. 3,898,056; 3,438,757; 3,565,804 and 4,022,589.

SUMMARY OF THE INVENTION

A process for reducing heat exchanger fouling in which a liquid hydrocarbon stream is passed through a heat exchanger at a temperature from 0° to 1500° F. wherein from 1 to 500 parts per million of a polyalkylene amine is added to said hydrocarbon stream.

DETAILED DESCRIPTION OF THE INVENTION

The heat exchangers utilized in the present invention are of any type where deposits accumulate on a heat transfer surface. The most common type of heat exchanger used is commonly known as a shell and tube heat exchanger.

The hydrocarbon stream passing through the heat exchanger is preferably a crude oil stream. However, any hydrocarbon stream which leads to fouling of the heat exchanger can be utilized in the present invention, particularly various fractions of the crude oil. Generally, the streams passing through the heat exchanger will be heated or cooled at temperatures ranging from 0° to 1500° F., preferably 50° to 500° F.

The polyalkylene amines which are suitable for use in the present invention are commercially available materials and have been used in automotive fuels for their detergent or dispersant properties. See, for example, U.S. Pat. No. 3,898,056, 3,438,757 and 4,022,589 for representative polyalkylene amines and methods of manufacture. The disclosures of these three patents are incorporated herein by reference.

As used in the present application, the term "polyalkylene amine" include monoamines and polyamines.

The polyalkylene amines are readily prepared by halogenating a relatively low molecular weight polyalkylene, such as polyisobutylene, followed by a reaction with a suitable amine such as ethylenediamine.

The polyalkylene may be prepared by ionic or free-radical polymerization of olefins having from 2 to 6 carbon atoms (ethylene must be copolymerized with another olefin) to an olefin of the desired molecular weight. Suitable olefins include ethylene, propylene, isobutylene, 1-butene, 1-pentene, 3-methyl-1-pentene, 4-methyl-1-pentene, etc. Propylene and isobutylene are most preferred.

The alkylene radical may have from 2 to 6 carbon atoms, and more usually from 2 to 4 carbon atoms. The alkylene group may be straight or branched chain.

The amines are selected from hydrocarbylamines, alkoxy-substituted hydrocarbylamines, and alkylene polyamines. Specific examples of hydrocarbylamines include methylamine, propylamine, butylamine, pentylamine, hexylamine, heptylamine, octylamine, di-n-butylamine, di-n-hexylamine, decylamine, dodecylamine, hexadecylamine, octadecylamine, etc. Specific examples of alkoxy-substituted hydrocarbyl amines include methoxyethylamine, butoxyhexylamine, propoxypropylamine, heptoxyethylamine, etc., as well as the poly(alkoxy)amines such as poly(ethoxy)ethylamine, poly(propoxy)ethylamine, poly(propoxy)-propylamine and the like.

Suitable examples of alkylene polyamines include, for the most part, alkylene polyamines conforming to the formula

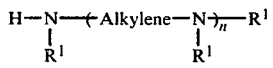

wherein (A) n is an integer preferably less than about 10; (B) each R′ indpendently represents hydrogen or a substantially saturated hydrocarbon radical; and (C) each Alkylene radical can be the same or different and is preferably a lower alkylene radical having 8 or less carbon atoms, and when Alkylene represents ethylene, the two R′ groups on adjacent nitrogen atoms may be taken together to form an ethylene group, thus forming a piperazine ring.

In a preferred embodiment, R′ represents hydrogen, methyl or ethyl. The alkylene amines include principally methylene amines, ethylene amines, propylene amines, butylene amines, pentylene amines, hexylene amines, heptylene amines, octylene amines, other polymethylene amines, and also the cyclic and the higher homologs of such amines such as piperazines and amino-alkyl-substituted piperazines. These amines are exemplified specifically by: ethylene diamine, diethylene triamine, triethylene tetramine, propylene diamine, octamethylene diamine, di(heptamethylene) triamine, tripropylene, tetramine, tetraethylene pentamine, trimethylene diamine, pentaethylene hexamine, di(-trimethylene) triamine, 2-heptyl-3-(2-aminopropyl-)imidazoline, 4-methylimidazoline, 1,3-bis(2-aminoethyl)imidazoline, 1-2(2-aminopropyl)piperazine, 1,4-bis(2-aminoethyl)piperazine, and 2-methyl-1-(2-aminobutyl)piperazine. Higher homologs such as are obtained by condensing two or more of the above-illustrated alkylene amines likewise are useful.

The polyalkylene amine will generally have an average molecular weight in the range of 200 to 2700, preferably 1000 to 1500 and will have been reacted with sufficient amine to contain from 0.8 to 7.0, preferably 0.8 to 1.2 weight percent basic nitrogen.

To substantially reduce the heat exchanger fouling an effective amount, generally from 1 to 500 parts per million, preferably 5 to 99 parts per million, and most preferably 10 to 49 parts per million of the above-described polyalkylene amine is added to the stream passing through the heat exchanger. One surprising feature of the present invention resides in the finding that such small quantities of the above-described additive are effective in reducing the heat exchanger fouling.

EXAMPLES

Three different additives were injected into the feed stream of a 25,000 barrel per day shell and tube heat exchanger. The feed stream consisted of a California crude oil. Before the start of each test, all of the exchangers were hot oil flushed and water washed. The crude feed rate for all tests ranged from 23,000 to 25,000 barrels per day. The anti-fou'ant injection rate was one gallon for each 1,000 barrels of feed. Throughout the test, the entry temperature of the crude oil was approximately 80° F. while the exit temperature was approximately 358° F. The fuel requirements to heat the crude oil was measured throughout the test. The furnace fuel consumption is shown in the attached table at various intervals. The antifoulants tested are as follows: A, a polyisobutylene amine having a molecular weight of approximately 1000 to 2000; B, Corexit 204 which is believed to be a polybutene carboxamide; C, Baroid AF-600 which is believed to be a mixture of polymeric glycols and polyamides.

TABLE I

| Additive | Time Weeks | Furnace Fired Duty BPOD EFO[1] | Savings Over Fouled Operation BPOD EFO[1] |
|---|---|---|---|
| None | Steady state[2] | 290.0 | 0.0 |
| A | 0 | 231.1 | 58.9 |
| B | 0 | 226.6 | 63.4 |
| C | 0 | 226.0 | 64.0 |
| A | 4 | 246.2 | 43.8 |
| B | 4 | 240.4 | 49.6 |
| C | 4 | 267.1 | 22.9 |
| A | 6 | 246.2 | 43.8 |
| B | 6 | 245.9 | 44.1 |
| C | 6 | 267.5 | 22.5 |
| A | 10 | 246.2 | 43.8 |
| B | 10 | 254.2 | 35.8 |
| C | 10 | 267.5 | 22.5 |

[1]Barrels per day of equivalent fuel oil.
[2]Steady state was reached after about 4 months of operation.

By comparing the slope of fouling versus time for the antifoulant during the first eight weeks of each test, it is apparent that the antifoulants effect the deposit fouling mechanism differently. The anti-foulant savings versus time at eight weeks and the projected savings over a one-year time span are shown in Table II.

TABLE II

| Anti-foulant | Net Saving Over Fouled Operation After 8 Weeks Bbl EFO | After One Year Bbl EFO |
|---|---|---|
| A | 2700 | 16,300 |
| B | 2700 | 13,800 |
| C | 1800 | 9,200 |

The above data indicates that the polybutene amine antifoulant of the subject invention at the end of eight weeks is equivalent or superior to the commercially available additives Corexit 204 and Baroid AF-600. At the end of one year, the polyalkylene amine additives for the present invention are clearly superior to the Exxon Corexit 204 and the Baroid AF-600.

What is claimed is:

1. A process for reducing heat exchanger fouling in which a liquid hydrocarbon stream is passed through a heat exchanger at a temperature from 0° to 1500° F. wherein from 1 to 500 parts per million of a polyalkylene amine is added to said hydrocarbon stream.

2. The process of claim 1 wherein said stream is crude oil.

3. The process of claim 1 wherein 5 to 99 parts per million of said polyalkylene amine is added to said stream.

4. The process of claim 1 wherein 10 to 49 parts per million of said polyalkylene amine is added to said stream.

5. The process of claim 1 wherein said hydrocarbon stream is passed through said heat exchanger at a temperature from 50° to 500° F.

6. The process of claim 4 wherein said polyalkylene amine has a molecular weight in the range of 220 to 2,700.

7. The process of claim 4 wherein said polyalkylene amine is a polybutene amine.

8. The process of claim 7 wherein said polyalkylene amine comprises a polyisobutylene amine having a molecular weight in the range of 1,000 to 1,500.

9. The process of claim 8 wherein said heat exchanger is a shell and tube heat exchanger.

* * * * *